US010955128B2

(12) United States Patent
Webb

(10) Patent No.: US 10,955,128 B2
(45) Date of Patent: Mar. 23, 2021

(54) LED BULB HAVING A MOUNTING BLOCK, HEAT SINK AND EXTENDABLE ELECTRODES COUPLED TO OPPOSING SIDES OF THE MOUNTING BLOCK

(71) Applicant: David Blair Webb, Brampton (CA)

(72) Inventor: David Blair Webb, Brampton (CA)

( * ) Notice: Subject to any disclaimer, the term of this patent is extended or adjusted under 35 U.S.C. 154(b) by 0 days.

(21) Appl. No.: 16/922,640

(22) Filed: Jul. 7, 2020

(65) Prior Publication Data

US 2020/0332996 A1 Oct. 22, 2020

Related U.S. Application Data

(63) Continuation of application No. 16/538,508, filed on Aug. 12, 2019, now Pat. No. 10,746,390, and a continuation of application No. 29/636,529, filed on Feb. 8, 2018, now Pat. No. Des. 862,742.

(51) Int. Cl.

| | |
|---|---|
| ***F21V 29/76*** | (2015.01) |
| ***F21V 23/06*** | (2006.01) |
| ***F21V 29/503*** | (2015.01) |
| *F21Y 105/10* | (2016.01) |
| *F21Y 115/10* | (2016.01) |

(52) U.S. Cl.

CPC ..... *F21V 29/763* (2015.01); *F21V 23/06* (2013.01); *F21V 29/503* (2015.01); *F21Y 2105/10* (2016.08); *F21Y 2115/10* (2016.08)

(58) Field of Classification Search

CPC .. F21Y 2115/10; F21Y 2105/10; F21V 23/06; F21K 9/27

See application file for complete search history.

*Primary Examiner* — Robert J May

(57) ABSTRACT

The invention is a reversible, automatically and self-adjustable light emitting diode (LED) component with a heatsink, a plurality of LED elements connected in parallel with half reversed, and two electrodes, each coupled to the main block by a spring. The LED component can be compressed by a user, shortening its length, placed in an LED holder, and then released. The reversed elements allow the LED component to be placed in either orientation with respect to current direction.

16 Claims, 5 Drawing Sheets

LED BULB HAVING A MOUNTING BLOCK, HEAT SINK AND EXTENDABLE ELECTRODES COUPLED TO OPPOSING SIDES OF THE MOUNTING BLOCK

CROSS REFERENCE TO RELATED APPLICATIONS

This application claims priority to U.S. Ser. No. 29/636,529 filed Feb. 8, 2018 entitled: LED BULB and U.S. Ser. No. 16/538,508 filed Aug. 12, 2019 entitled LED BULB HAVING A MOUNTING BLOCK, HEAT SINK, AND EXTENDABLE ELECTRODES COUPLED TO OPPOSING SIDES OF THE MOUNTING BLOCK, the contents of which are incorporated herein by reference.

TECHNICAL FIELD

The present invention relates to light-emitting, diodes (LED).

BACKGROUND

Light-emitting diodes (LED) are semiconductor light sources which consume less power and last longer than traditional incandescent light bulbs. LEDs can be manufactured to produce ultraviolet, infrared, or visible light. LEDs produce tight when a current is allowed to flow from the positive anode to the negative cathode across a semiconductor, displacing electrons which subsequently release photons, LEDs can also be made much smaller than traditional light sources, allowing them to be placed on substrates such as printed circuit boards (PCBs). Elements in electronic circuits can be either reversible or irreversible with respect to current flow. Resistors are an example of a reversible, or orientation-agnostic element, which operates essentially identically regardless of current direction. Diodes including LEDs are irreversible, or orientation-specific elements, which operate differently, or not at all, if the current direction changes.

SUMMARY

The present invention is a light-emitting diode (LED) component which is reversible, or orientation-agnostic with respect to current direction, and which is also length-adjustable. It can therefore fit in LED sockets or holders of a range of sizes. The invention is an LED component with art LED mounting block having a rectangular prism shape and having a top surface, a bottom surface and a first side, second side, third side and fourth side, the first and third sides being oriented opposite each other, and the second and fourth sides being oriented opposite each other. There is a heat, sink component mounted to the bottom surface of the LED mounting block. A first electrode is coupled to a first side of the LED mounting block and a second electrode is coupled to the third side of the LED mounting, block. A spring is interposed between the first electrode and the mounting block so that the LED component length can be varied. A plurality of LED elements is arranged on the top surface of the LED mounting block. In an embodiment, there are 8 LED elements comprised of 2 columns with 4 rows of elements. The LED elements are coupled from positive to negative electrode in parallel with half of the elements being oriented backwards, such that half of the elements are activated regardless of current direction.

BRIEF DESCRIPTION OF THE DRAWINGS

For a better understanding of the present invention including the features, advantages and specific embodiments, reference is made to the following detailed description along with accompanying Figures, in which.

DETAILED DESCRIPTION

Figure 1:
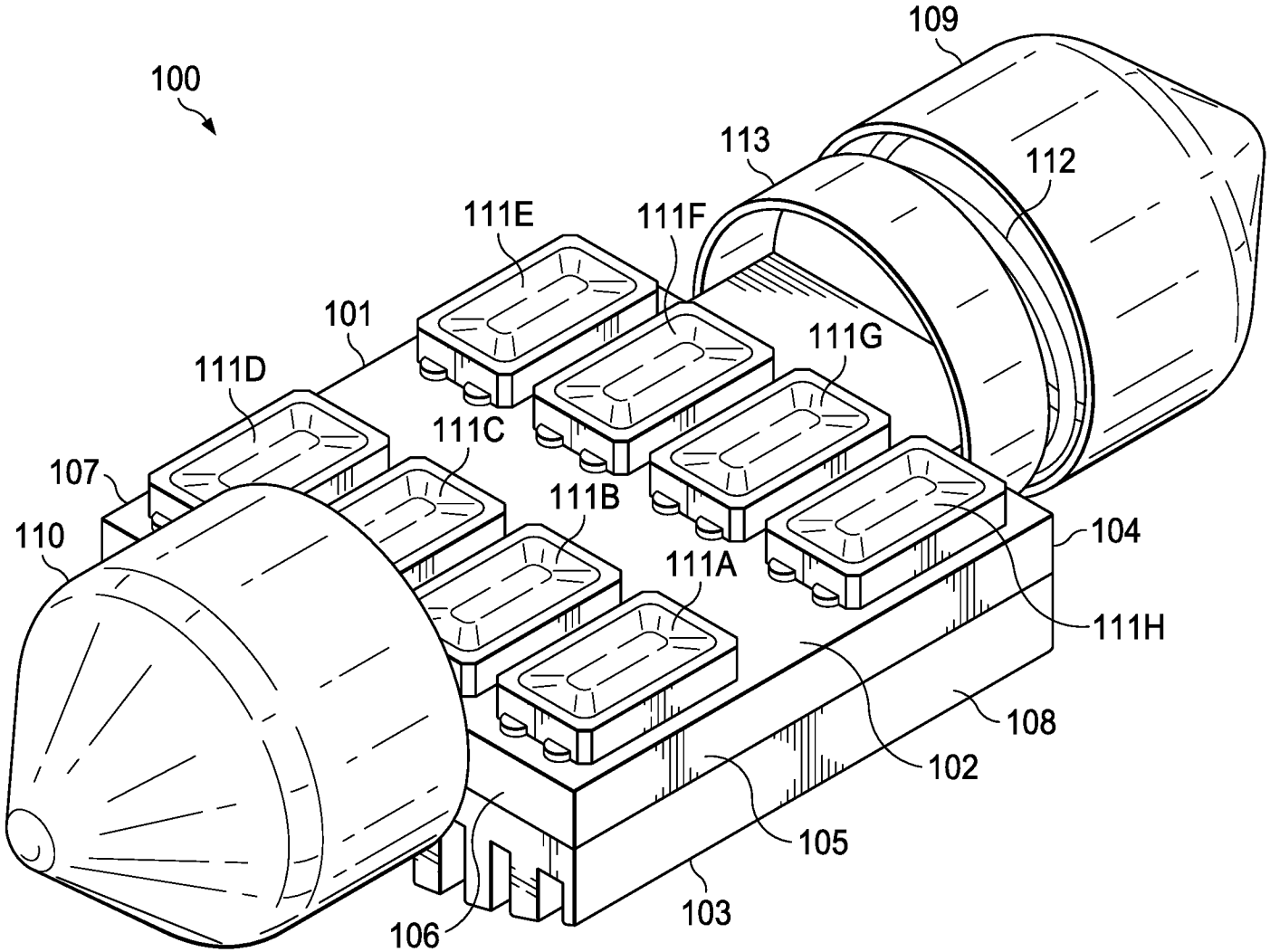
FIG. 1 is a top perspective view of an LED bulb in accordance with the present invention in an extended configuration.

While the making and using of the disclosed embodiments of the present invention is discussed in detail below; it should be appreciated that the present invention provides many applicable inventive concepts which can be embodied in a wide variety of specific contexts, some features of the preferred embodiments shown and discussed may be simplified or exaggerated for illustrating the principles of the invention.

Reference will now be made in detail to the preferred embodiment of the present invention.

Referring to FIGS. 1-5, the invention is a light emitting diode (LED) component 100 with an LED mounting block 101 having a quadrilateral-prism shape and having a top surface 102, a bottom surface 103 and a first side 104, second side 105, third side 106 and fourth side 107. There is a heat sink component 108 mounted to the bottom surface of the LED mounting block 10L said heat-sink being made of a metal or other heat-conducting material and comprising a plurality of long, thin fins 200 extending outwards radially from a longitudinal vector running through both end barrels, said fins being flat and thin in order to increase the ratio of surface area to volume of each individual fin, said fins being slightly splayed apart from each other to improve heat transfer characteristics. A first end barrel 100 is coupled to a first side 104 of the LED mounting block and a second end barrel 110 is coupled to the third side 106 of the LED mounting block 101. A plurality of LED elements 111A-H is arranged on the top surface of the LED mounting block 101.

Figure 2:
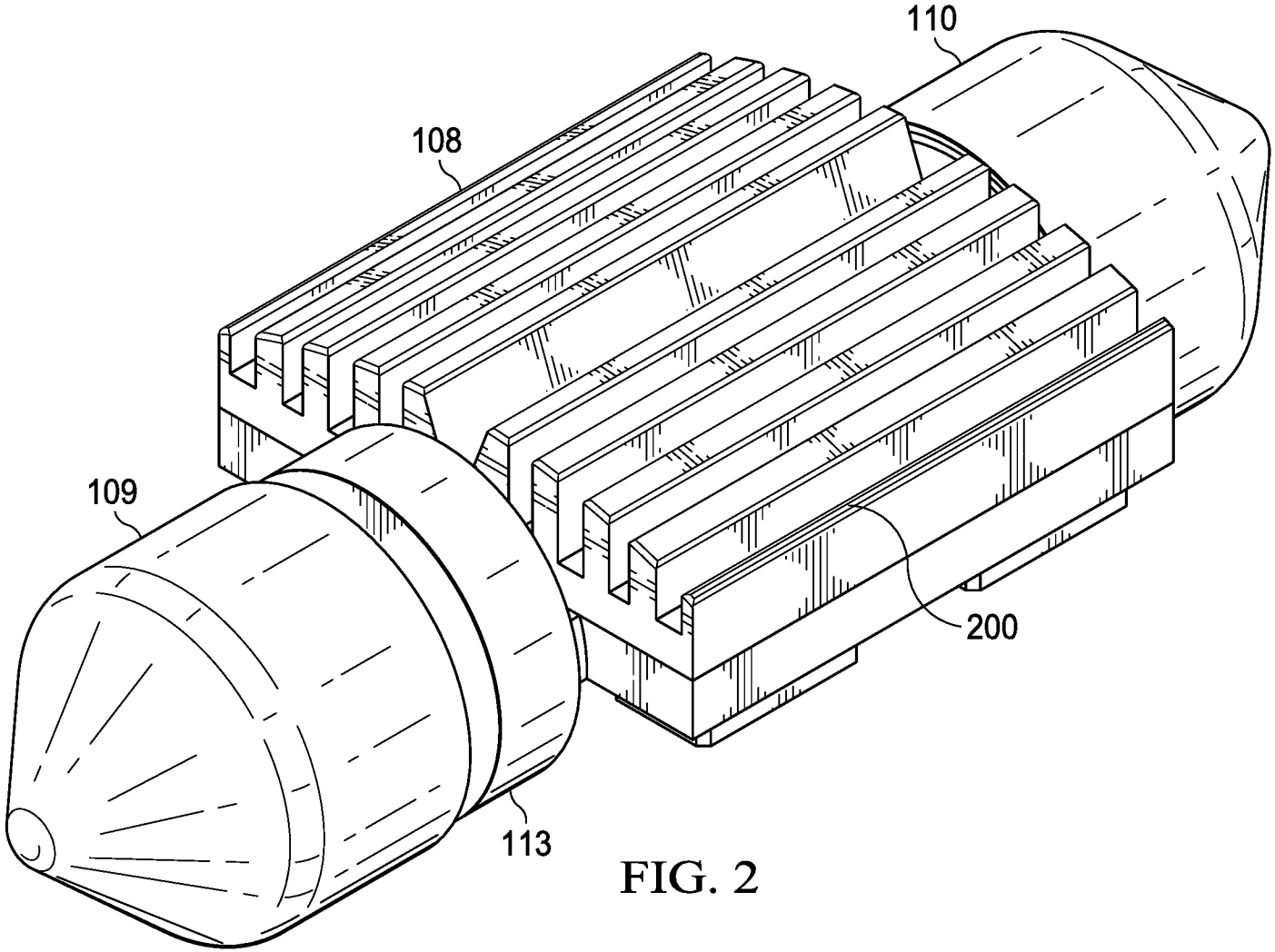
FIG. 2 is a bottom perspective view thereof.
Figure 3:
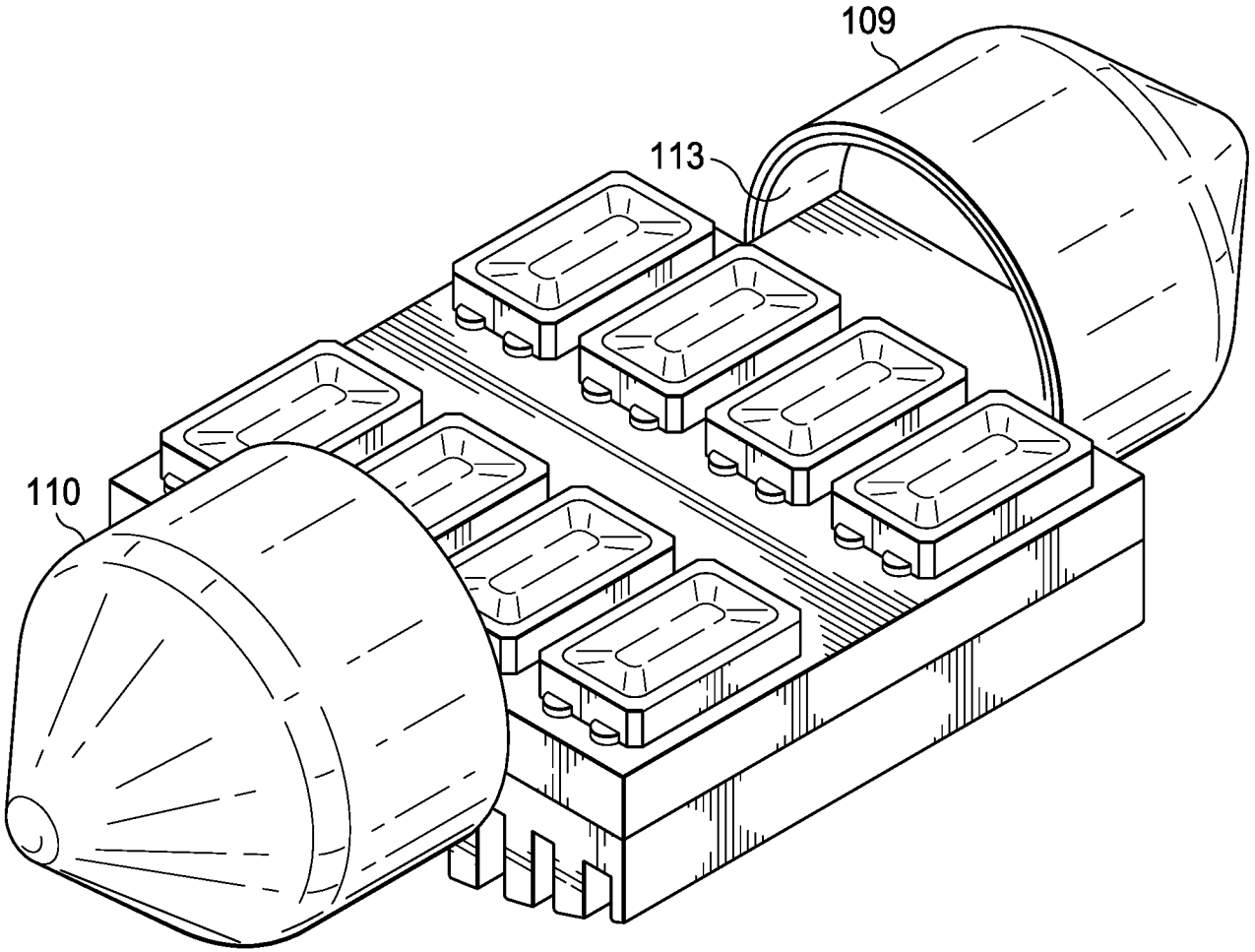
FIG. 3 is a top perspective view of an LED bulb in accordance with the present invention in a compressed configuration.
Figure 4:
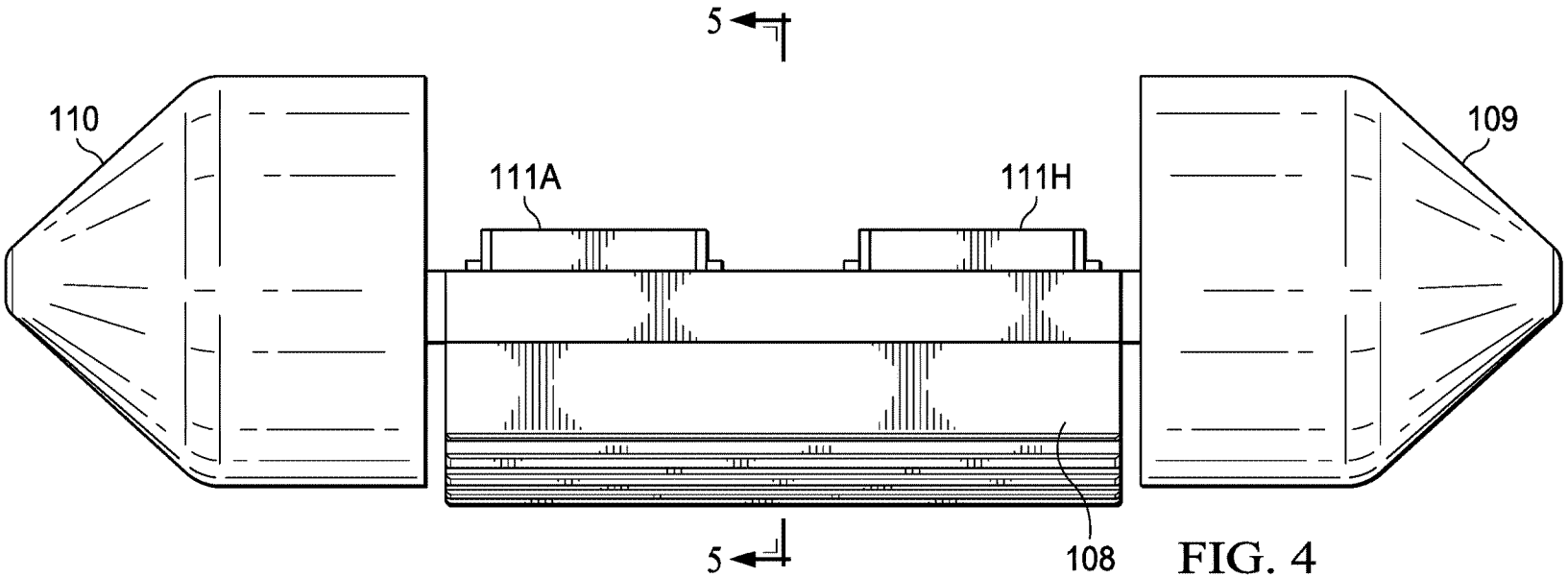
FIG. 4 is a side plan view thereof.
Figure 5:
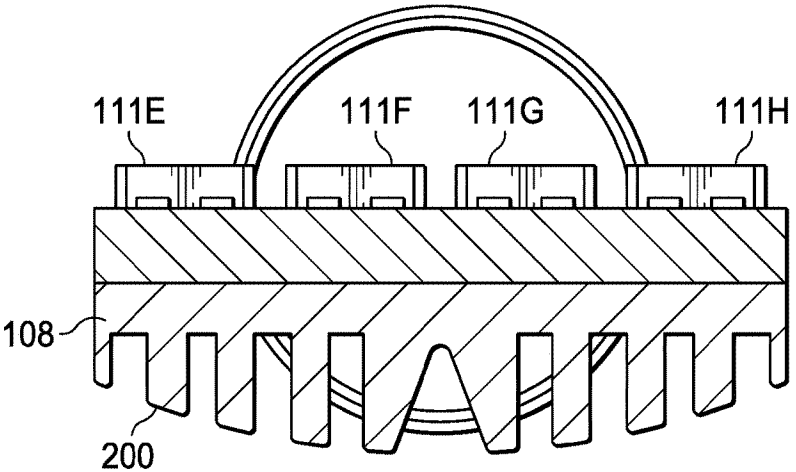
FIG. 5 is a sectional cutaway corresponding to the section indicated in FIG. 4.

The first end barrel 109 is coupled to a spring 112 which is seated in a spring barrel housing 113, such that the invention can be made to fit in a variety of LED holders by compressing said spring, inserting said invention into said LED holder, and releasing said spring. Said end barrels act as electrodes (one the anode and the other the cathode) and are connected via physical contact to an external power source such that the invention forms part of an electrical circuit. In an embodiment, both end barrels comprise springs and spring barrel housings or other length adjusting mechanism such as threaded, interlocked coaxial elements, in this manner, the LED bulb 100 is automatically and infinitely self-adjustable. With reference to the foregoing description. FIG. 1 is a top perspective view of an LED bulb 100 in accordance with the present invention in an extended configuration. FIG. 2 is a bottom perspective view thereof of LED bulb 100. FIG. 3 is a top perspective view of an LED bulb 100 in accordance with the present invention in a compressed configuration. FIG. 4 is a side plan view thereof of LED bulb 100 and FIG. 5 is a sectional cutaway corresponding to the section indicated in FIG. 4.

Figure 6:
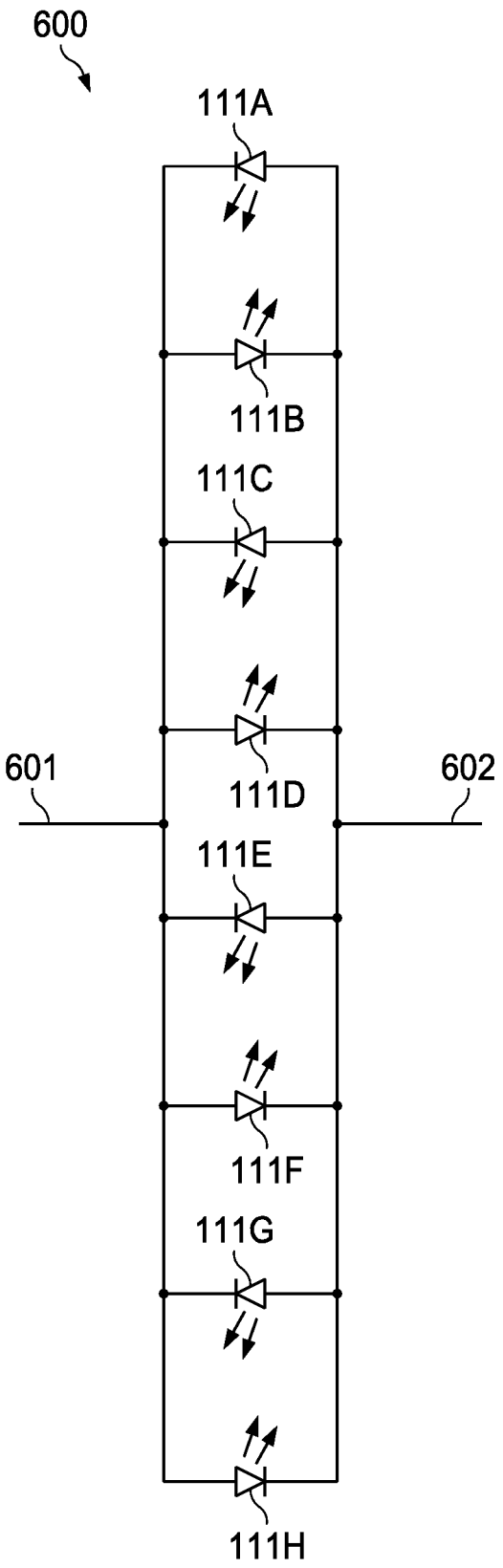
FIG. 6 is a circuit diagram of an LED bulb in accordance with the present invention.

As seen in FIG. 6, in an embodiment, there are 8 LED elements comprised of 2 columns with 4 rows of elements. The LED elements are coupled using circuitry 600 operable to connect the LED elements such that the 8 LED elements 111A-H are connected in parallel with 4 elements oriented so that they are activated by current flowing from anode 60$ to cathode 602 and the remaining 4 elements oriented so that they are activated by current flowing from cathode to anode. In this way, the invention will always have 4 LED elements activated regardless of apparatus orientation with respect to current flow of the parent circuit. Hence, the LED elements are coupled from positive to negative electrode in parallel with half of the elements being oriented backwards, such that half of the elements are activated regardless of current direction.

The embodiments shown and described above are only exemplars. Even though numerous characteristics and advantages of the present invention have been set forth in the foregoing description together with details of the connectors of the present invention, the disclosure is illustrative only and changes may be made within the principles of the invention to the full extent indicated by the broad general meaning of the terms used herein. Various alterations, modifications and substitutions can be made to the disclosed invention without departing in any way from the spirit and scope of the invention.

What is claimed is:

1. An apparatus, comprising:

an LED mounting block having, a rectangular prism shape and having a top surface, a bottom surface, and a first side, second side, third side and fourth side, said first and third sides being oriented opposite each other, said second and fourth sides being oriented opposite each other;

a heat sink component mounted to the bottom surface of the LED mounting block;

a first electrode coupled via a first extensible mechanism to the first side of the LED mounting block wherein said first extensible mechanism comprises a first spring interposed between the first electrode and a first end barrel, said first end barrel being a hollow cylinder for housing the first spring and being mounted on the first side of said LED mounting block, said first electrode being dimensioned so as to fit snugly into said first end barrel when said first spring is compressed;

a second electrode coupled via a second extensible mechanism to the third side of the LED mounting block; wherein said second extensible mechanism comprises a second spring interposed between the second electrode and a second end barrel, said second end barrel being a hollow cylinder for housing the second spring and being mounted on the third side of said LED mounting block, said second electrode being dimensioned so as to fit snugly into said second end barrel when said second spring is compressed, a plurality of LED elements arranged on the top surface of the LED mounting block; and circuitry operable to connect the LED elements.

2. The apparatus of claim 1, wherein the LED bulb is automatically and infinitely self-adjusting.

3. The apparatus of claim 1, wherein the elements are connected in parallel.

4. The apparatus of claim 1, wherein half of the LED elements are reversed such that they are oriented in the direction opposite the remaining LED elements, orientation being with respect to current flow through said elements.

5. The apparatus of claim 1, wherein the LED mounting block comprises a substrate made of PCB.

6. The apparatus of claim 1, wherein the heat sink comprises a plurality of fins extending outward from said LED mounting block bottom surface.

7. The apparatus of claim 6, wherein the heat sink fins are made of a heat-conductive metal such as copper.

8. The apparatus of claim 1, wherein the electrodes are made of an electrically-conductive metal such as gold plate, silver, or copper.

9. A light emitting bulb (LED) apparatus, comprising:

an LED mounting block;

a heal sink component mourned to the bottom surface of the LED mounting block;

a first electrode coupled via a first extensible mechanism to the first side of the LED mounting block wherein said first extensible mechanism comprises a first spring interposed between the first electrode and a first end barrel said first end barrel being a hollow cylinder for housing the first spring and being mounted on the first side of said LED mounting block, said first electrode being dimensioned so as to fit snugly into said first end barrel when said first spring is compressed;

a second electrode coupled via a second extensible mechanism to the third side of the LED mounting block; wherein said second extensible mechanism comprises a second spring interposed between the second electrode and a second end barrel, said second end barrel being a hollow cylinder for housing the second spring and being mounted on the third side of said LED mounting block, said second electrode being dimensioned so as to fit snugly into said second end barrel when said second spring is compressed, a plurality of LED elements arranged on the top surface of the LED mounting block; and conductive material operable to interconnect the LED elements.

10. The apparatus of claim 9, wherein the LED bulb is automatically and infinitely self-adjusting.

11. The apparatus of claim 9, wherein the LED elements are connected in parallel.

12. The apparatus of claim 9, wherein half of the LED elements are reversed such that they are oriented in the direction opposite the remaining LED elements, orientation being with respect to current flow through said elements.

13. The apparatus of claim 9, wherein the LED mounting block comprises a substrate made of PCB.

14. The apparatus of claim 9, wherein the heat sink comprises a plurality of fins extending outward from said LED mounting block bottom surface.

15. The apparatus of claim 14, wherein the heat sink fins are made of a heat-conductive metal such as copper.

16. The apparatus of claim 9, wherein the electrodes are made of an electrically-conductive metal such as gold plate, silver, or copper.

* * * * *